US006511026B2

(12) United States Patent
Hatfield

(10) Patent No.: US 6,511,026 B2
(45) Date of Patent: Jan. 28, 2003

(54) BAG OPENER SUPPORT APPARATUS

(76) Inventor: Jerry Hatfield, 38076 River Bend, Farmington Hills, MI (US) 48335

( * ) Notice: Subject to any disclaimer, the term of this patent is extended or adjusted under 35 U.S.C. 154(b) by 32 days.

(21) Appl. No.: 09/736,658

(22) Filed: Dec. 14, 2000

(65) Prior Publication Data

US 2002/0027181 A1 Mar. 7, 2002

Related U.S. Application Data

(60) Provisional application No. 60/170,993, filed on Dec. 15, 1999.

(51) Int. Cl.[7] ..... A63B 55/04

(52) U.S. Cl. ..... 248/97; 141/391; 248/95; 248/99

(58) Field of Search ..... 248/95, 128, 97, 248/132, 99, 136, 146, 147; D6/462; 280/47.29, 639; 141/390, 391

(56) References Cited

U.S. PATENT DOCUMENTS

| | | | | | |
|---|---|---|---|---|---|
| 4,174,085 | A | | 11/1979 | Ferreira et al. | 248/97 |
| 4,304,378 | A | * | 12/1981 | Briggs | 248/97 |
| 4,940,200 | A | | 7/1990 | Sawyer et al. | 248/97 |
| 5,016,844 | A | | 5/1991 | Garvin | 248/97 |
| RE33,842 | E | * | 3/1992 | Ebentheuer | 248/97 |
| 5,222,536 | A | | 6/1993 | Hodgdon et al. | 141/390 |
| D368,185 | S | | 3/1996 | Sawyer | D6/462 |
| 5,775,649 | A | | 7/1998 | O'Leary | 248/97 |
| 5,868,364 | A | * | 2/1999 | MacMillian | 248/97 |
| 6,003,894 | A | * | 12/1999 | Maher | 280/639 |
| 6,076,782 | A | * | 6/2000 | Alderman | 248/97 |
| 6,126,183 | A | * | 10/2000 | Lensing | 280/47.29 |
| 6,164,607 | A | * | 12/2000 | Hawkes | 248/97 |
| D447,845 | S | * | 9/2001 | Neil | D34/6 |
| 6,334,593 | B2 | * | 1/2002 | Inoue | 248/95 |

OTHER PUBLICATIONS

*Easy Bagger* 2 brochure, Model #300, The Wilmarc Co. (US Design #D368, 185).

* cited by examiner

*Primary Examiner*—Leslie A. Braun
*Assistant Examiner*—Tan Le
(74) *Attorney, Agent, or Firm*—Young & Basile, PC

(57) ABSTRACT

A bag opener support apparatus includes a frame having members movable between a collapsed position allowing easy insertion through an end of a flexible container to an expanded position in which the members are movable to a position expanding the interior of the flexible container and the open end of the container to a full cross section shape. The apparatus includes first and second frame members formed of interconnected side legs, with the second frame members pivotally connected to the first frame member for pivotal movement between the collapsed and expanded positions. A lock arm is mountable on one of the second frame members for lockingly engaging the opposed second frame member to maintain the second frame members in the expanded position.

11 Claims, 1 Drawing Sheet

BAG OPENER SUPPORT APPARATUS

CROSS REFERENCE TO CO-PENDING APPLICATION

This application claims the benefit of the filing date of U.S. provisional application Ser. No. 60/170,993 filed Dec. 15, 1999, the contents of which are incorporated herein in their entirety.

BACKGROUND OF THE INVENTION

This invention relates, in general, to devices for holding flexible walled containers, such as plastic and paper containers or bags, in an open position for filling with leaves and other debris.

Various devices or holders have been devised to hold the mouth of flexible containers open to enable easy filling of the bags with debris or waste and, in particular, leaves, by freeing both of the user's hands from holding the container.

Such containers are extremely flexible such that it is difficult to hold one end sufficiently open with one hand in order to fill the container with leaves or other debris with the other hand. Once the containers are filled to about mid-level, the containers will have sufficient support to be freestanding on the ground. However, the mouth or open end of the container may still partially close or collapse inward thereby making further insertion of debris difficult.

Opening devices for such flexible containers are typically in the form of a frame structure formed of rods or hollow plastic tubes which are wide, deep and high enough to maintain the container at its fullest interior dimensions and, more importantly, to maintain the mouth of the container fully open.

Such frames typically have opposed pairs of legs with cross members extending between each pair of legs and between the legs of each pair of legs. Typically, one pair of legs is pivotal with respect to the other pair of legs to enable the frame to collapse to a small, compact, generally planar shape when not in use as well as for insertion into an empty container.

However, most of such opening devices do not include means to hold the pivotal legs in an expanded, open position or, if such means are provided, such holding means are complicated and costly or require the use of tools to secure fasteners, for example, in a fixed position between the legs. This detracts from the easy use of such bag opening devices.

Thus, it would be desirable to provide an opener device for a thin walled, flexible container which is insertable into the container and functions to hold the container in a fully expanded position with the open end of the container fully open for easy insertion of waste, leaves or debris into the container. It would also be desirable to provide such an opener device which is easily lockable and unlockable in an expanded position for ease of insertion into and removal from the container.

SUMMARY

A flexible container or bag opener support apparatus is disclosed which is insertable through an end of a flexible container or bag and is then movable to an expanded position holding the interior of the bag and the open end of the bag in a full open cross section.

In a broad configuration, the apparatus includes a first frame member; two second frame members, each pivotally connected to the first frame member and movable between an expanded position and a collapsed position with respect to the first frame member. The second frame members, when in the expanded position, cooperate with the first frame member for maintaining the container in the fully opened, interior cross section and open ended state. Lock means are releasably engagable between the second frame members for maintaining the second frame members in the expanded position.

In a specific aspect of the invention, the first frame member includes a pair of spaced side legs and an interconnecting cross leg. Preferably, the side legs and the cross leg of the first frame member are formed as an integral, one piece unit from a hollow, tubular member.

In another aspect of the invention, each of the second frame members include a connector leg pivotally connected to one of the side legs of the first frame member and a side leg fixed to the connector leg and extending therefrom. Preferably, the side legs of the second frame members are disposed in parallel to the side legs of the first frame member when in the expanded position.

The lock means, in one aspect of the invention, is preferably in the form of a lock arm pivotally connected to one of the second frame members, and a lock member carried at an outer end of the lock arm. The lock member is releasably engagable with the opposed second frame member to maintain the side legs of the second frame member in the expanded position; while allowing pivotal movement of the side legs relative to the first frame member when the lock member is disengaged from the opposed side leg of the second frame member.

In a specific aspect, the lock arm carries a lock member at one end which is engagable with the opposed second frame member. In an exemplary aspect, the lock member in the form of an arcuate flange carried on the end of the lock arm and disposable in registry with the opposed side leg of the second frame member.

The pivotal mounting of the second frame members on the first frame member allows the second frame members to be collapsed into an overlying, folded position allowing easy storage of the bag opener support apparatus when not in use as well as easy insertion of the apparatus into an empty container.

The bag opener support apparatus of the present invention has a simple construction with a minimal number of separate components for a low manufacturing cost. The opener apparatus is easy to use and can be easily inserted into empty containers and then expanded to form the container to its full cross section end opening and interior size. After the container is full or partially full of debris, the opener apparatus may be easily removed through the open end of the container.

The lock arm carried on the second frame members holds the second frame members in the expanded position despite any impact from debris inserted through the open end of the bag into the interior of the bag.

BRIEF DESCRIPTION OF THE DRAWING

The various features, advantages and other uses of the present invention will become more apparent by referring to the following detailed description and drawing in which.

DETAILED DESCRIPTION

Figure 1:
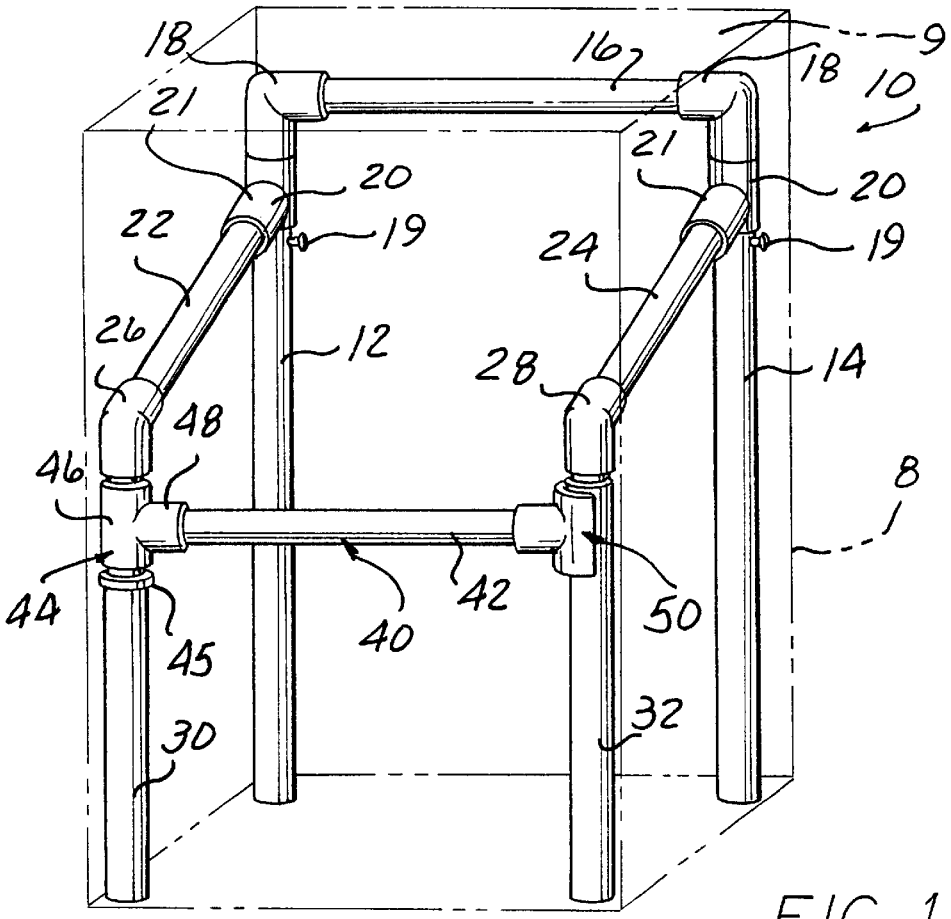
FIG. 1 is a perspective view showing the opener device of the present invention in an expanded position within a flexible container shown in phantom.
Figure 2:
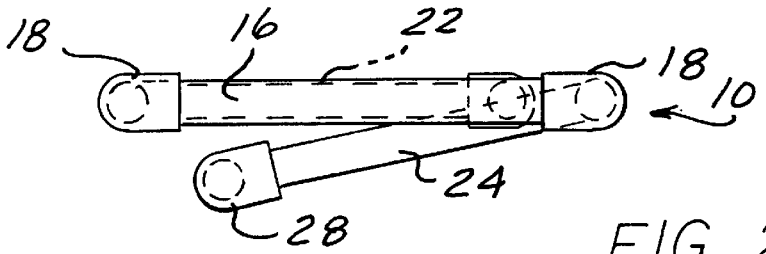
FIG. 2 is a plan view of the opener device shown in FIG. 1 depicted in a collapsed, storage position.
Figure 3:
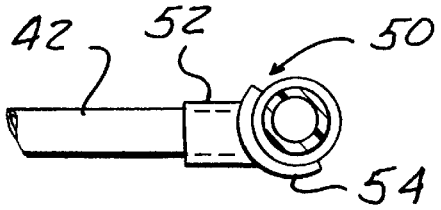
FIG. 3 is a plan, cross-sectional view showing the lock means of the opener device of the present invention in a lock position.

Referring now to the drawing, and to FIGS. 1–3 in particular, there is depicted an opener device suitable for use in holding a flexible container L such as a paper or plastic bag devised for receiving waste, debris, leaves, etc., in a fully expanded position wherein the openable end 9 of the container 8 is in a fully expanded or open condition for ease in filling the container 8 with debris, and especially leaves.

As is well known, waste, leaf or debris containers 8 or bags are typically formed of lightweight material, such as plastic or paper. Such containers 8 have a closed interior with an essentially circular cross section in the case of plastic bags, or rectangular or square in the case of disposable paper leaf bags. Such containers 8 include the openable end 9 which is expandable to allow insertion or removal of debris into or out of the interior of the container 8.

The present invention is an opener device 10 having dimensions for holding a flexible container 8, shown by way of example only, a paper container having a generally rectangular cross section with an open end 9, in a fully expanded, open position, with the open end 9 of the container 8 retained in an open position for ease of insertion of debris, such as leaves, into the expanded interior of the container 8.

By way of example only, the opener 10 of the present invention is formed of a lightweight plastic, tubular material, such as PVC plastic. The various elbows and tees of the opener 10 are also formed of the same PVC plastic for a low manufacturing cost and durable long-term use.

As shown in FIG. 1, the opener 10 includes a U-shaped frame formed of a first pair of side legs 12 and 14 having a suitable length sized for maintaining a particular sized container, such as a 30 gallon plastic or paper leaf bag having a height of 3 to 4 feet, in a fully expanded position with the open end 9 of the container 8 maintained in a fully opened position. The first pair of side legs 12 and 14 are designed to be disposed in a substantially vertical position when mounted within a container 8. A cross leg 16 extends between the first pair side legs 12 and 14, typically between one end of the side legs 12 and 14, by example only. The first cross leg 16 is fixedly joined to the first pair of side legs 12 and 14 by means of connectors, such as 90° elbows 18. One elbow 18 is mounted on each end of the first cross leg 16 and is fixedly joined to one end of the first pair of side legs 12 and 14.

The elbows 18 may be joined to the first cross leg 16 and the first pair of side legs 12 and 14 by suitable means, such as by a press-together, interference fit or, more permanently, by use of adhesives, such as epoxy adhesives typically used with plastic pipe.

A pair of rotatable connectors 20 are rotatably mounted on the first pair of side legs 12 and 14. The rotatable connectors 20 each comprise a tee member having a sleeve portion with an inner diameter greater than the outer diameter of the first pair of side legs 12 and 14 to permit rotation of the rotatable connector 20 about each of the first pair of side legs 12 and 14. The rotatable connectors 20 are rotatably held in position on the first pair of side legs 12 and 14 by means of stop members 19. In a preferred example, each stop member 19 is in the form of a screw or fastener, such as a self-drilling or self-tapping screw, which is mounted in each side leg 12 and 14 at the position shown in FIG. 1. The lower end of each rotatable connector 20 rests on the stop member 19, but is capable of rotational movement as described hereafter. Other types of stop members may also be employed. For example, each stop member could also be an O-ring which is tightly mounted about one of the first pair of side legs 12 and 14 at a suitable position to retain the rotatable connector 20 on the first pair of side legs 12 and 14 adjacent to the elbow 18.

An angled leg 21 extends from the sleeve portion of each rotatable connector 20. The angled leg 21 may be disposed at a 45° for a 90° angle with respect to the sleeve portion, with a 45° angle shown by way of example only in FIG. 1. The angled leg 21 of each rotatable connector 20 receives one end of a connector leg 22 or 24. The outer diameter of the connector legs 22 and 24 is selected to enable one end of each connector leg 22 and 24 to be inserted into the angled leg 21 of one of the rotatable connectors 20 in a tight, press-fit or secured thereto by an adhesive.

The other end of each of the connector legs 22 and 24 is fixedly mounted in an elbow 26 and 28, respectively. In the case of a 45° angled leg 21 on the rotatable connector 20, the elbows 26 and 28 will also have a 45° shape. If the angled leg of each rotatable connector 20 is at a 90° angle with respect to the sleeve portion, then the elbows 26 and 28 will have a similar 90° configuration.

The elbows 26 and 28 fixedly receive one end of a second pair of side legs 30 and 32. The second pair of side legs 30 and 32 have a slightly shorter overall length than the first pair of side legs 12 and 14.

Although the first pair of side legs 12 and 14 and the first cross leg 16 have been described as being formed of separate members fixedly joined together into a generally inverted U-shaped frame by means of the elbows 18, it will be understood that the U-shaped frame may be unitarily formed of a one-piece, bent member having a planar or arcuate cross leg corresponding to the first cross leg 16.

Likewise, each upper connector leg 22 and 24 may be unitarily formed with one of the second pair of side legs 30 and 32, respectively, in a one-piece construction which is joined at one end to one of the rotatable connectors 20.

The rotatable connectors 20 rotatably connect the first connector leg 22 and the side leg 30 of the second pair of side legs 30 and 32 as well as the connector leg 24 and the other side leg 32 of the second pair of side legs 30 and 32 in a rotatable manner with respect to the first pair of side legs 12 and 14. This enables the second pair of side legs 30 and 32 to be moved to an expanded position shown in FIG. 1 wherein the second pair of side legs 30 and 32 are disposed in a common plane spaced from the plane formed by the first pair of side legs 12 and 14 and the first cross leg 16. The overall length of the connector legs 22 and 24 as well as the length of the first cross leg 16 are selected to correspond to the expanded, full interior dimensions of the flexible container 8 for which the opener device 10 is designed to be used. The length of the first pair of side legs 12 and 14 and the second pair of side legs 30 and 32 will also be chosen so as to maintain the container 8 in a fully expanded position substantially along its entire height as well as, in combination with the connector legs 22 and 24 and the cross leg 16, to hold the opened end 9 of the container 8 in a fully open position.

This enables the second pair of side legs 30 and 32 as well as the respective connector legs 22 and 24 are also movable to a collapsed position shown in FIG. 2 suitable for convenient storage, transport, etc. In the collapsed position, the connector leg/second pair of side leg pairs 22 and 30, and 24 and 32, are pivoted inward and slightly overlay each other adjacent to or in the plane of the first pair of side legs 12 and 14.

The opener 10 of the present invention includes a unique lock means 40 for locking the first pair of side legs 30 and 32 in the expanded position, while enabling easy pivotal, collapsible movement of the side legs 30 and 32 to the storage position shown in FIG. 2.

According to the present invention, the lock means 40 is in the form of a lock arm 42 which is fixedly joined at one end to a rotatable connector 44. The rotatable connector 44 is preferably in the form of a 90° tee member having a sleeve portion 46 with an inner diameter greater than the outer diameter of the side leg 30 to enable rotation of the rotatable connector 44 about the side leg 30. The rotatable connector 44 also includes an intermediate leg 48 extending substantially centrally from the sleeve 46 and fixedly receiving the lock arm 42 in a press-fit or adhesively joined connection. It will be understood, also, that the lock arm 42 may be integrally formed as a unitary part of the intermediate leg 48 of the rotatable connector 44.

A stop member, such as an O-ring 45, is fixedly mounted on the side leg 30 at a position spaced from one end of the elbow 26 to rotatably mount the rotatable connector 44 on the side leg 30 in the desired position adjacent to the elbow 26 as shown in FIG. 1.

A lock member 50 is fixedly carried at an outer end of the lock arm 42. The lock member 50 is constructed from a 90°, hollow, plastic elbow having an intermediate leg portion 52 joined to the lock arm 42. The leg portion 52 extends generally centrally from a sleeve portion 54. The sleeve portion 54 is cut or formed into a C-shape as shown in FIG. 3 to concentrically conform to the outer diameter of the side leg 32 when the lock arm 42 is in the lock position extending between the second pair of side legs 30 and 32. The sleeve 54 merely engages the side leg 32 to hold the side leg 32 in a spaced apart position from the opposed side leg 30.

In use, the opening device or opener 10 will generally be in the collapsed position shown in FIG. 2. When it is desired to use the opener 10 with a container 8, the connector leg/side leg pairs 22 and 30, and 24 and 32 are pivoted about the respective rotatable connectors 20 to a generally perpendicular position with respect to the first pair of side legs 12 and 14 as shown in FIG. 1. The lock arm 42 is then rotated about the side leg 32 until the sleeve 54 engages the opposed side leg 32.

The expanded opener 10 can then inserted into a flexible container 8 with the bottom ends of the first and second pairs of side legs 12 and 14, and 30 and 32 seated on the bottom of the container 8. In this configuration, the opener 10 maintains the container 8 in a fully expanded position allowing easy insertion of debris, especially leaves, into the open interior of the container 8; while at the same maintaining the end or mouth 9 of the container 8 in a fully open position.

However, it will also be understood that the above-described expansion of the opening device 10 from the collapsed position shown in FIG. 2 to the open or expanded position shown in FIG. 1 preferably takes place within a partially open container 8. This simplifies the mounting of the opener 10 within the container 8, and at the same time, ensures that the container 8 is in the fully expanded position.

After debris or leaves have been inserted into the container 8 to a level substantially near the top of the container sufficient to maintain the open end 9 of the container 8 in a full or nearly fully open position, the opener 10 may be removed from the container 8 by an upward force on the first cross leg 16 or either of the connector legs 22 and 24.

With the opener 10 removed from the container 8, the lock arm 42 is then pivoted about the side leg 30 releasing the sleeve 54 from the side leg 32 and enabling the second pair of side legs 30 and 32 to be collapsed to the storage position shown in FIG. 2.

The opener apparatus of the present invention provides several advantages over previously devised opening devices designed for use with flexible containers, such as leaf bags. The opener apparatus is simple and easy to use and, at the same time, ensures that the expanded legs of the opener apparatus remain in the fully expanded position within the container without the need for hand manipulable fasteners or fasteners requiring tools to lock the pivotal legs in the expanded position.

What is claimed is:

1. An opener apparatus adapted for insertion into a flexible container for supporting the container in a full cross section interior and with a full cross section open end, the opener apparatus comprising:

a first frame member having a first pair of spaced side legs and an interconnecting cross leg;

two second frame members pivotally connected to the first frame member and movable between an expanded position and a collapsed position with respect to the first frame member, the second frame members, when in the expanded position, cooperating with the first frame member for maintaining the container in the fully opened, interior cross section and open ended shape; and lock means, releasably engagable between the two second frame members, for maintaining the two second frame members in the expanded position.

2. The opener apparatus of claim 1 wherein the first and second side legs and the interconnecting cross leg of the first frame member are integrally formed as a one piece member.

3. The opener apparatus of claim 1 wherein each of the second frame members comprises:

a connector leg pivotally connected to one of the first and second side legs frame member and a side leg fixed to the connector leg and extending therefrom.

4. The opener apparatus of claim 3 wherein:

the side legs of the second frame members extend in parallel to the side first and second legs of the first frame member.

5. The opener apparatus of claim 1 wherein each of the second frame members comprises:

a connector leg pivotally connected to the first frame member and a side leg fixed to the connector leg and extending therefrom.

6. The opener apparatus of claim 5 wherein each connector leg extends substantially perpendicular to the corresponding side leg of each second frame member.

7. The opener apparatus of claim 5 wherein the lock means comprises:

a lock arm pivotally connected to one side leg of one of the second frame members; and a lock member carried on the lock arm, the lock member releasably engagable with a side leg of an opposed second frame member to maintain the side legs of the second frame member in the expanded position while allowing pivotal movement of the side legs relative to the first frame member when the lock member is disengaged from the opposed side leg.

8. The opener apparatus of claim 7 wherein the lock member comprises:

an arcuate flange carried on an end of the lock arm disposable in registry with the side leg of the opposed second frame member.

9. The opener apparatus of claim 1 wherein the second frame members are foldable over each other in the collapsed position.

10. The opener apparatus of claim 1 wherein the lock means comprises:

a lock arm pivotally connected to one of the second frame members; and a lock member carried at an outer end of the lock arm, the lock member releasably engagable with an opposed second frame member to maintain the side legs of the second frame member in the expanded position while allowing pivotal movement of the side legs relative to the frame member when the lock member is disengaged from the opposed side leg.

11. The opener apparatus of claim 10 wherein the lock member comprises:

an arcuate flange carried on an end of the lock arm disposable in registry with the opposed second frame member.

* * * * *